United States Patent [19]

Brügger

[11] Patent Number: 4,587,680

[45] Date of Patent: May 13, 1986

[54] HAIR WASHING BASIN OR BOWL FOR HAIRDRESSERS

[75] Inventor: Kurt Brügger, Magden, Switzerland

[73] Assignee: Franco Scarnato, Ruschlikon, Switzerland

[21] Appl. No.: 624,668

[22] PCT Filed: Oct. 13, 1983

[86] PCT No.: PCT/CH83/00116

§ 371 Date: Jun. 11, 1984

§ 102(e) Date: Jun. 11, 1984

[87] PCT Pub. No.: WO84/01495

PCT Pub. Date: Apr. 26, 1984

[30] Foreign Application Priority Data

Oct. 18, 1982 [CH] Switzerland ..... 6047/82

[51] Int. Cl.[4] ..... A45D 19/08; A45D 19/10; E03C 1/14

[52] U.S. Cl. ..... 4/519; 4/515; 4/520; 4/619

[58] Field of Search ..... 4/515, 519, 522, 521, 4/618, 616, 619, 517

[56] References Cited

U.S. PATENT DOCUMENTS

| | | | |
|---|---|---|---|
| 1,791,348 | 2/1931 | Cannady | 4/522 |
| 1,898,314 | 2/1933 | Sandhagen | 4/519 |
| 3,108,288 | 10/1963 | Herzog | 4/519 |
| 3,733,620 | 5/1973 | Glintz | 4/515 |

FOREIGN PATENT DOCUMENTS

| | | | |
|---|---|---|---|
| 1142459 | 9/1957 | France . | |
| 1225873 | 3/1971 | United Kingdom | 4/519 |

*Primary Examiner*—Henry K. Artis

*Attorney, Agent, or Firm*—Karl F. Ross; Herbert Dubno

[57] ABSTRACT

A hair washing basin or bowl for hairdressers or the like is provided with a recess for the nape of the neck on the edge of the basin or bowl as well as with an opening at the deepest location of the basin or bowl for evacuating the washing and rinsing water. The inside of the basin is provided with an obstacle limiting the water flow path inside the basin which leads to the evacuation opening, forming a wall and imparting a circular motion to the flowing water. Owing to said elements, long hairs will remain in the limited flow path and will be continuously and throughout their length immersed in the washing and rinsing water without the risk for the hair ends of entering the evacuation opening.

5 Claims, 4 Drawing Figures

HAIR WASHING BASIN OR BOWL FOR HAIRDRESSERS

CROSS REFERENCE TO RELATED APPLICATIONS

This application is a national phase application corresponding to PCT/CH83/00116 filed Oct. 13, 1983 and based, under the International Convention, upon Swiss National Application No. 6047/82 of Oct. 18, 1882.

FIELD OF THE INVENTION

The present invention relates to a hair washing basin or bowl for hairdressers, hospitals, private persons or the like, provided with a recess for the nape of the neck on the edge of the basin or bowl as well as an opening at the deepest location of the basin or bowl for evacuation the washing and rinsing water.

BACKGROUND OF THE INVENTION

Is is common practice that washing appliances are employed for the washing of hair particularly in hairdressers' salon, but also in hospitals or occasionally in private residences, by which the person concerned leans his head backwards against the washing basin or bowl, his neck being fixed at the height of the hairline in a recess on the edge of the basin or the bowl.

The washing and rinsing water being applied as a rule by a third person, then flows directly from the head and from the half hanging in the basin or bowl, and from there flows directly into the evacuation opening.

This professional washing technique has, however, in particular, the disadvantage that longish hair can spread out in the whole basin and/or the ends of which can be swept along into the evacuation opening together with the washing and rinsing water that is draining off, so, therefore, long hair must be continuously held up high, free from the bottom of the basin in order to ensure a perfect washing and rinsing process. which presents a highly unsatisfying handling.

OBJECT OF THE INVENTION

Therefore, with the foregoing in mind it is a primary object of the present invention to provide a suitable hair washing basin or bowl for the previously described washing technique in such a manner that the previously mentioned drawbacks are avoided.

Now in order to implement these and still further objects of the invention, which will become more readily apparent as the description proceeds, the hair washing basin of the present development is manifested by the features that the inside of the basin is provided with an obstacle limiting the water flow path inside the basin which leads to the evacuation opening, forming a wall and imparting a circular motion to the flowing water.

Owing to said elements, according to invention, long hair will remain in the limited flow path and will be continuously and throughout its length immersed in the washing and rinsing water without the risk for the hair ends of entering the evacuation opening. This not only has advantages in connection with long hair but also permits an essentially better control of the cleanness of the rinsing water for short hair, said water being more easily observed and judged along its relatively long flow path. Moreover, previously overlooked hairclasps and the like will no longer be washed directly and often unnoticed into the drain-pipe but will remain lying on the obstacle on the obstacle on the way along the flow path to the evacuation opening.

An advantageous embodiment of the hair washing basin or bowl according to invention has the obstacle and the inner wall of the bowl or basin define a flow path which has a gradient and which becomes narrower from its recess towards the evacuation opening.

These elements lead to an inevitable acceleration of the rinsing water towards the ends of the hair, being manifested in an increased rinsing value at a relatively slight water consumption, owing to the increased flow speed of the water effectively removing all washing residue.

For production reasons and for an attractive design, it is of further advantage if the obstruction forms an integrated part or the body of the basin or bowl, and, further, if the obstruction extends in an open arc from the edge recess round the evacuation opening.

Advantageously the basin or bowl is formed as an attachment or insertion basin which may be connected to existing basins or bowls.

The hair washing basin or bowl can be advantageously cast or sprayed out of porcelain or plastic or drawn out from metal.

BRIEF DESCRIPTION OF THE DRAWING

The invention will be better understood and objects other than those set forth above, will become apparent when consideration is given to the following detailed description thereof. Such description makes reference to the annexed drawing wherein.

SPECIFIC DESCRIPTION

Figure 1:
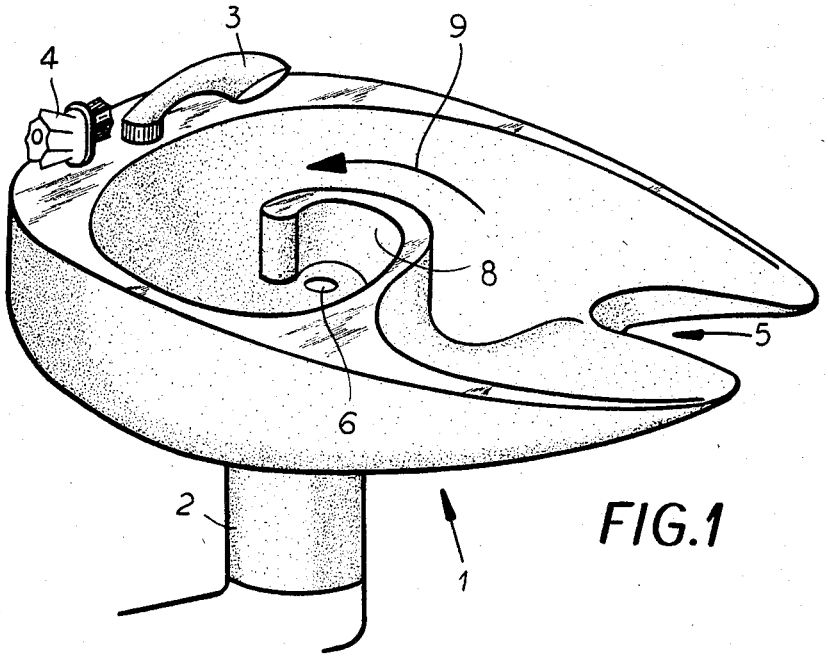
FIG. 1 is a perspective view of the hair washing basin according to invention in diagrammatic representation.
Figure 2:
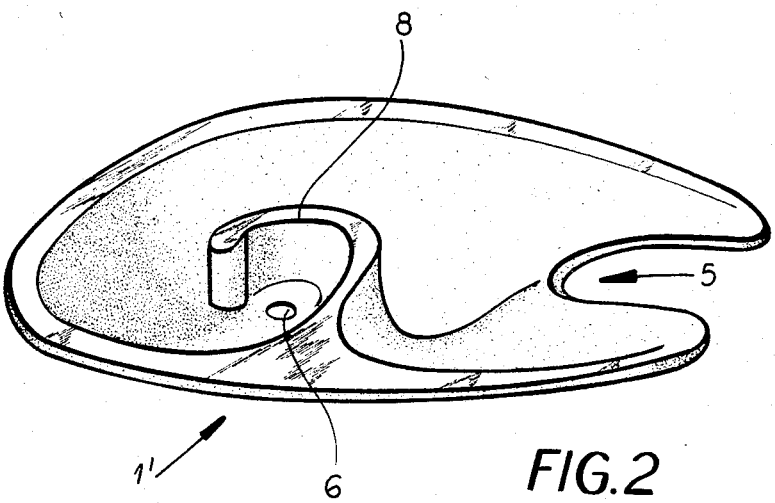
FIG. 2 is a perspective view of the interior of a hair washing basin according to invention in diagrammatic representation.
Figure 3:
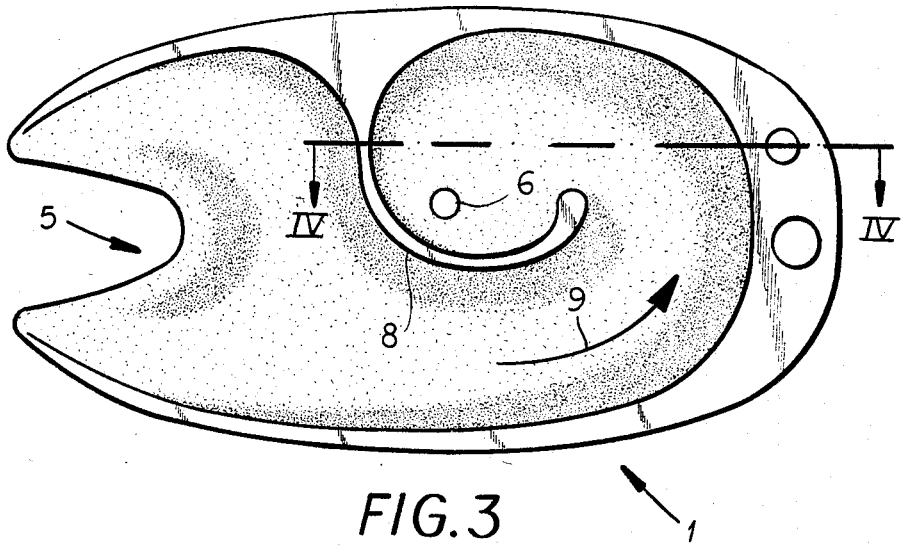
FIG. 3 shown the arrangement according to FIG. 1 in plan view.
Figure 4:
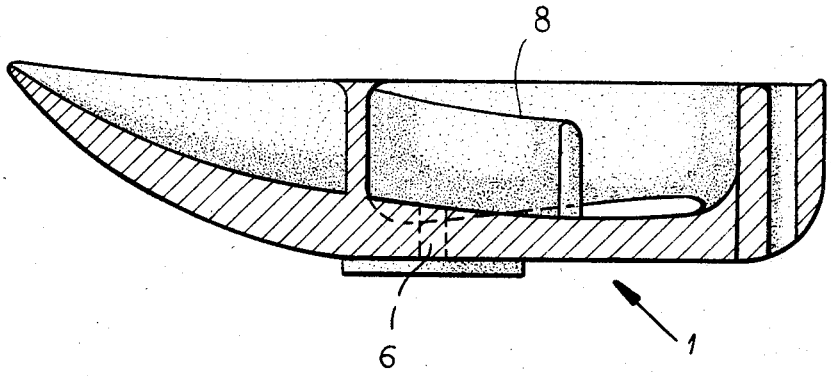
FIG. 4 shows the arrangement according to FIG. 3 shown along the profile line IV—IV.

The object of invention is shown in FIG. 1 as a hair washing basin 1 upon a swivel support (not shown in detail) with a hand shower 3 and the tap fittings 4; whereas FIG. 2 presents the object or invention as a hair washing basin 1' which can be placed on an existing basin, making, thus, a re-equipping of an existing arrangement possible.

Naturally, both construction forms possess the essential characteristics of the invention, with the construction form according to FIG. 1 being as a rule cast out of porcelain or plastic, and the construction form according to FIG. 2 consisting of a sprayed hard plastic or a drawn metal.

According to FIGS. 1 to 4, the basin 1 or the bowl 1' is provided in known manner with a recess 5 for the nape of the neck on the edge of the basin, as well as with an opening 6 at the deepest location of the basin or bowl for evacuating the washing and rinsing water. Bowls of this kind have a longish form, the evacuating opening 6 being situated in the center of the bowl or, as described, arranged situated somewhat laterally.

According to invention, the inside of the basin 1 or the bowl 1' is provided with an obstacle 8 limiting the water flow path inside the basin or the bowl, and imparting a circular motion to the flowing water. As can be seen from the drawings, the obstacle 8 forms an integrated part of the basin 1 or the bowl 1', the obstruction 8 extending in an open arc from the edge recess 5 round the evacuation opening 6.

Preferably, the development is made in such a way that the obstacle 8 and the inner wall of the basin 1 or bowl 1' define a flow path 9 which has a gradient and which becomes narrower from the recess 5 of the bowl towards the evacuation opening 6.

There is in the region of the recess 5 of the basin a trumpet-like widening of the flow path 9 which permits a good accessibility and handling of the hair to be washed. Owing to said refinements of the flow path 9 according to invention, long hair will automatically remain in this path and will be continuously and thoroughly imersed in the washing and rinsing water without the risk for the hair ends of entering the evacuation opening 5. particularly since the accelerated water, as previously described, has the tendency to press the hair outwardly against the wall of the basin, which enlarges the surface area between the recess 5 and the evacuation opening 6 for the laying down of the hair.

In this way, it is now possible for the first time to produce a hair washing basin or hair washing bowl, the conception of which being able to meet all the previously-mentioned requirements.

While there are shown and described present preferred embodiments of the invention, it is to be distinctly understood that the invention is not limited thereto, but may be otherwise variously embodied and practiced within the scope of the following claims. 9n

What I claim is:

1. A hair washing basin for hairdressers, hospitals, private persons or the like comprising:

means defining a recess for the nape of the neck on the edge of the basin as well as an opening at the deepest location of the basin for evacuating the washing and rinsing water, the inside of the basin being provided with an obstacle limiting the flow path inside the basin which leads to an evacuation opening, said obstacle forming a wall and imparting a circular motion to the flowing water, said obstacle extending in an open arc from the edge recess around the evacuation opening.

2. The hair washing basin as defined in claim 1, wherein:

an obstacle and the inner wall of the bowl define a flow path which has a gradient and which becomes narrower from its said recess towards the evacuation opening.

3. The hair washing basin as defined in claim 1, wherein:

the obstruction forms an integrated part of the body of the basin.

4. The hair washing basin as defined in claim 1, wherein:

said basin is formed as an insert for another basin.

5. The hair washing basin as defined in claim 1, which is cast or sprayed out of porcelain or plastics or drawn out of metal.

* * * * *